US008459189B1

(12) United States Patent
Steinbok et al.

(10) Patent No.: US 8,459,189 B1
(45) Date of Patent: Jun. 11, 2013

(54) TABLE DISPLAY AND SHIPPING PLATFORM CONVERTIBLE APPARATUS

(76) Inventors: Harry Steinbok, Boca Raton, FL (US); Milton Shafran, Fort Lauderdale, FL (US)

( * ) Notice: Subject to any disclaimer, the term of this patent is extended or adjusted under 35 U.S.C. 154(b) by 345 days.

(21) Appl. No.: 12/983,316

(22) Filed: Jan. 2, 2011

Related U.S. Application Data

(60) Provisional application No. 61/291,897, filed on Jan. 2, 2010.

(51) Int. Cl.
*A47B 3/00* (2006.01)

(52) U.S. Cl.
CPC ..... *A47B 3/002* (2013.01)
USPC ..... 108/11; 108/118; 108/57.31; 248/164; 248/431; 248/432

(58) Field of Classification Search
USPC ..... 108/57.26, 57.31, 12, 16, 17, 153.1, 108/154, 155, 157.1, 158.11, 158.12, 11, 108/18, 14, 51.11, 118, 175, 170, 171, 166, 108/167; 248/166, 168, 169, 171, 164, 431, 248/432, 188, 188.1, 188.6
See application file for complete search history.

(56) References Cited

U.S. PATENT DOCUMENTS 957,439 A * 5/1910 McGuigan ..... 108/16
1,252,766 A * 1/1918 Anderson ..... 108/35
1,553,036 A * 9/1925 Foss ..... 108/171
1,564,189 A * 12/1925 Anderson ..... 108/35
1,976,031 A * 10/1934 Lowenberg ..... 108/12
2,068,591 A * 1/1937 Bennett ..... 312/236
2,937,062 A * 5/1960 Kruse ..... 108/34
3,063,667 A * 11/1962 Doty, Jr. et al. ..... 248/150
3,601,067 A 8/1971 Olsen
3,804,032 A 4/1974 Baucom
3,807,581 A 4/1974 Nichols
3,941,291 A 3/1976 Hayworth
5,097,957 A * 3/1992 Adams et al. ..... 206/557
6,769,367 B2 8/2004 Schutz
2003/0136308 A1* 7/2003 Lung ..... 108/12
2007/0227406 A1 10/2007 Korbonski
2008/0223262 A1 9/2008 Chew et al.
2010/0257673 A1* 10/2010 Linares ..... 5/626

* cited by examiner

*Primary Examiner* — Janet M Wilkens
(74) *Attorney, Agent, or Firm* — Allen D. Hertz, P.A.; Allan D. Hertz

(57) ABSTRACT

A pair of platform assemblies, each having a pair of bracket assemblies being parallel and symmetrically arranged to an underside of a platform. Each bracket assembly is sized and shaped to receive and store a pair of legs during shipping. In a shipping configuration, the platform assemblies are abutted and joined along a mating edge. The pair of legs is inserted into each bracket assembly providing support to the formed shipping platform. A series of leg-receiving apertures are formed in each bracket assembly for insertion of a shoulder of each leg to convert the platform into a table. A brace and locking system can be integrated to reinforce the leg subassembly interface and support. A series of table configurations can be joined to increase the display table width or length as desired.

18 Claims, 13 Drawing Sheets

TABLE DISPLAY AND SHIPPING PLATFORM CONVERTIBLE APPARATUS

CROSS-REFERENCE TO RELATED APPLICATION

This application is a divisional application co-pending U.S. Provisional Patent Application Ser. No. 61/291,897, filed on Jan. 2, 2010, which is incorporated herein in its entirety.

FIELD OF THE INVENTION

The present invention relates to a display and shipping apparatus, and more particularly, a shipping apparatus that converts to a display table, the apparatus being used for transporting objects to trade shows and displaying objects at the trade shows and similar events.

BACKGROUND OF THE INVENTION

The invention pertains to a shipping apparatus that converts to a presentation table for transporting to and displaying objects at trade shows and similar events. Conversely, the table assembly (provided by a pair of tables) is converted to a shipping apparatus.

Marketing planning must include a means for transporting samples and other display materials to and from promotional expositions.

An exposition, commonly referred to as a trade show or trade fair, is an exhibition organized so that companies in a specific industry can showcase and demonstrate their latest products, service, study activities of rivals, and examine recent trends and opportunities. Some expositions are open to the public (classified as "Public"), while others are limited to company representatives (members of the trade) and members of the press (classified as "Trade only"). The expositions are held on a continuing basis in virtually all markets, normally attracting companies from around the globe. To understand the size of these expositions, there are currently over 2500 expositions held annually in the United States.

Expositions often involve a considerable marketing investment by the participating companies. Costs include space rental, design and construction of trade show displays, transportation of the displays and materials, telecommunications and networking, travel, accommodations, and promotional literature and items to give to attendees. In addition, costs are incurred at the show for services such as electrical, booth cleaning, Internet services, and drayage (also known as material handling).

Several shipping pallets are known to include a series of legs that attach in a vertical orientation to the pallet platform. The legs must be packaged with the display materials for transport to and from the expositions. The leg attachment interface is generally considered as acceptable, but not solid. Further, the leg interface is not self-stabilizing.

When shipping material to an exposition or other event, the shipping material is normally stored in a location outside of the display arena. When collapsing and preparing to return the display, the personnel need to wait until the shipping materials are returned from the stored location.

Accordingly, there remains a need in the art for a device that provides both display capabilities and shipping capabilities to aid in preparation, presentation, and closure of an exposition.

SUMMARY OF THE INVENTION

The present invention overcomes the deficiencies of the known art and the problems that remain unsolved by providing a method and respective apparatus for shipping and display of items to and from exhibitions.

In accordance with one embodiment of the present invention, the invention consists of a display table and shipping platform apparatus comprising:

a first platform assembly;

a second platform assembly;

each platform assembly comprising a platform and a pair of leg receiving frame members disposed upon an underside of each platform, said pair of leg receiving frame members being parallel and symmetrically arranged to an underside of each platform;

at least one leg receiving aperture provided through a sidewall of the leg receiving frame members; and at least two leg subassemblies, each leg subassembly comprising a pair of legs being pivotally attached proximate a central portion of the legs, wherein the leg receiving frame members are formed for receiving and storing the leg subassemblies therein.

In one aspect, the leg receiving frame members of the first platform align with the leg receiving frame members of the second platform when the first and second platforms are abutted, wherein the inserted legs provide support across a joint formed between both the first and second platforms when the display table and shipping platform apparatus is assembled in a shipping configuration.

Yet another aspect, the platform assemblies further comprise at least one platform-to-platform attachment interface for securing two adjacent platform assemblies together.

While another aspect, the platform-to-platform attachment interface further comprising a slot having a pin aperture disposed at each end of the slot and a rectangular "U" shaped securing pin that is inserted through the two pin apertures.

With yet another aspect, a wobble brace is provided, being assembled between each pair of leg subassemblies. The wobble brace is preferably assembled between the pivot and the attachment shoulder of the leg subassemblies. The wobble brace is inserted into a receiving aperture, said receiving aperture being respectively located.

Yet another aspect, a wobble brace storage slot is provided within at least one of the legs for receiving and storing one or more wobble brace during shipping.

Regarding another aspect, the legs of the leg subassemblies are rotated into an "X" configuration and the shoulders are inserted through the leg receiving apertures of each of the bracket assemblies.

In yet another aspect, each bracket assembly further comprises an interior leg receiving aperture and a respective exterior leg-receiving aperture.

Another aspect includes a shoulder stop tab located on an exterior flange of each of the bracket assemblies for limiting motion of the shoulder of each leg.

In another aspect, a handle aperture is provided through the platform. The handle aperture is preferably centrally positioned proximate a longer edge of the platform. It is understood that any handle design can be integrated with the platform assembly.

While another aspect allows the conversion between a table configuration and a shipping configuration (and vice versa) to be accomplished without the need to any tools.

With another aspect is a reduction or elimination of a need for storage of the shipping materials.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

Figure 1:
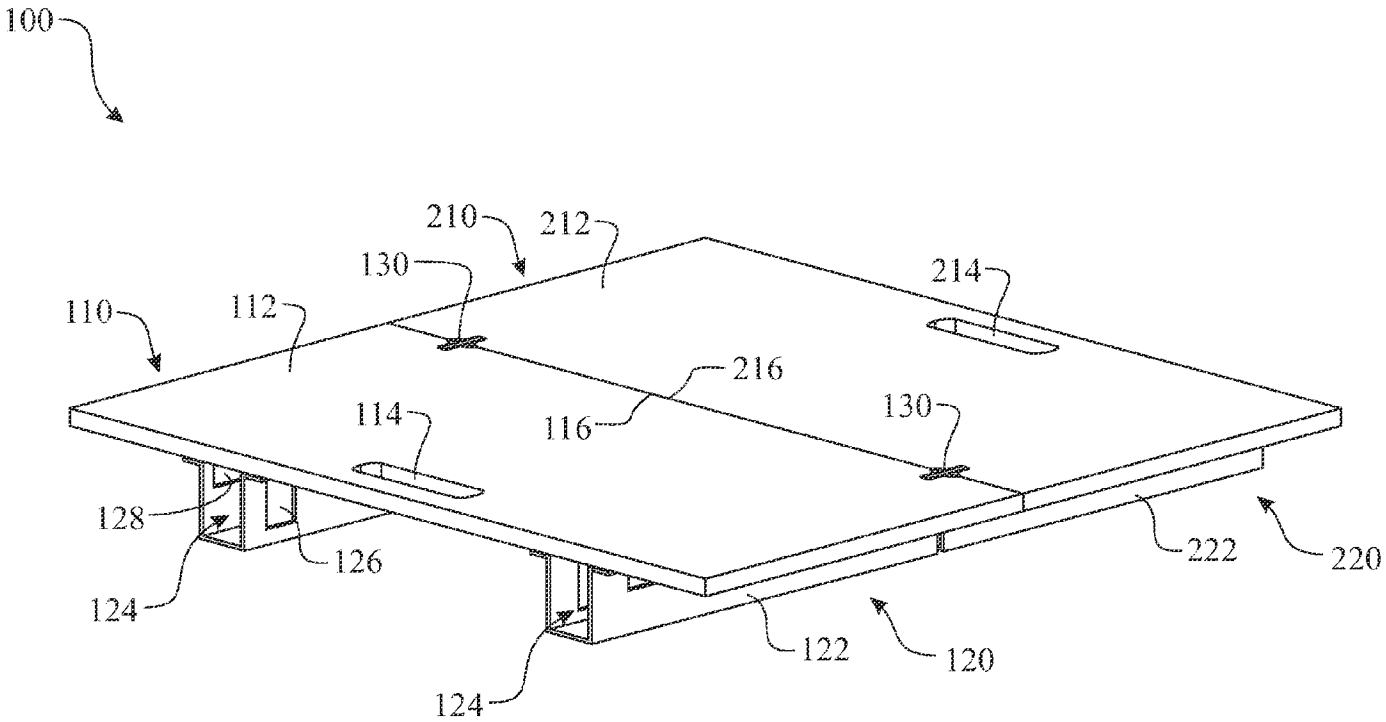
FIG. 1 presents an isometric view of a display table and shipping platform apparatus shown in a shipping configuration.
Figure 2:
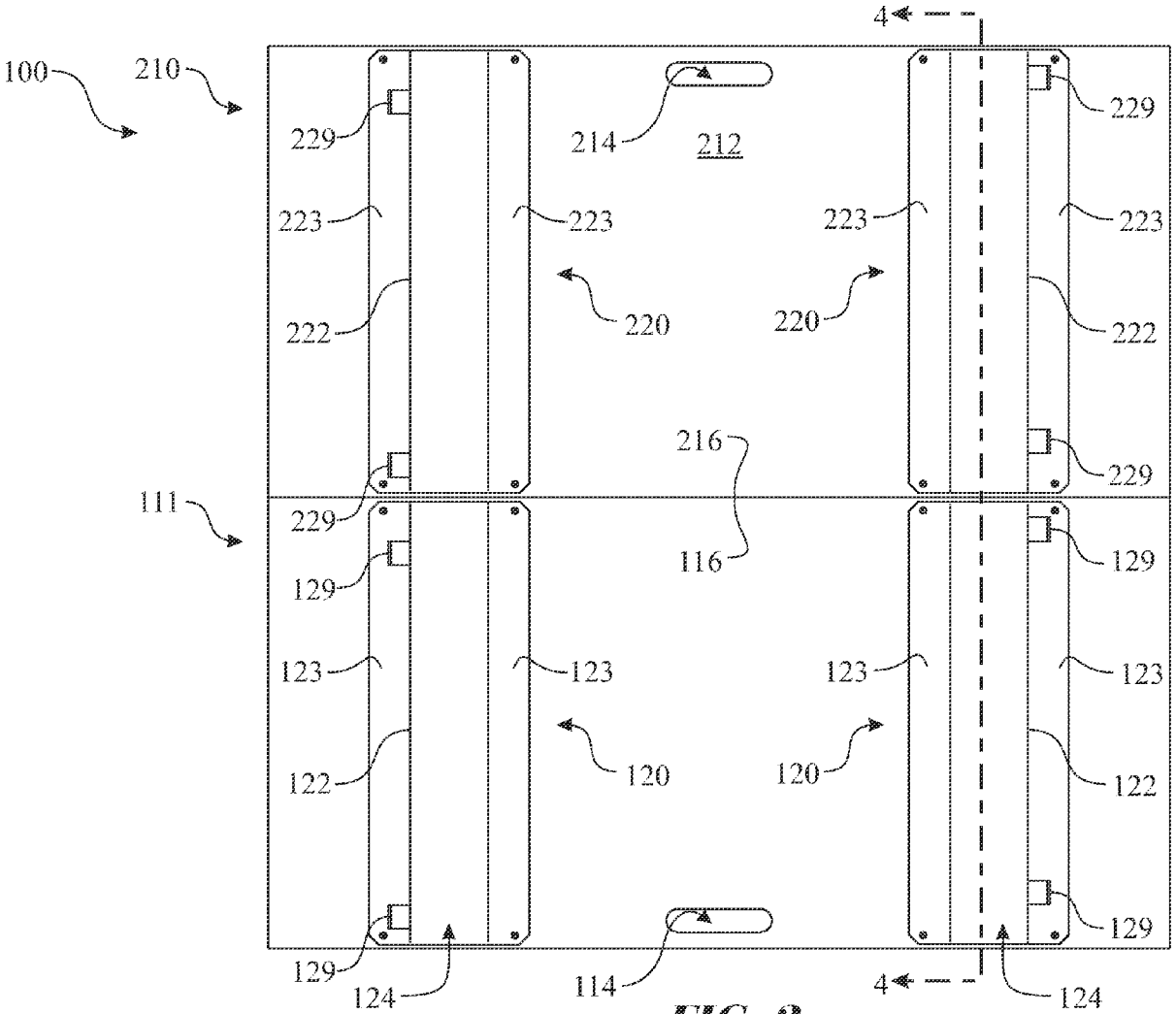
FIG. 2 presents a bottom side planar view of the display table and shipping platform apparatus of FIG. 1, shown in a shipping configuration.

For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

An exemplary display table and shipping platform apparatus 100 is illustrated in a transport or shipping configuration as presented in FIGS. 1 through 4. The display table and shipping platform apparatus 100 comprises a first platform assembly 110 and a second platform assembly 210 being assembled via a plurality of platform-to-platform attachment interfaces 130. Each platform assembly 110, 210 is fabricated having a pair of bracket assemblies 120 assembled to an underside of a platform 112 in a parallel arrangement. The bracket assemblies 120 are spaced to allow forks of a standard pallet jack to be inserted between facing sidewalls of the bracket assembly 120.

Figure 3:
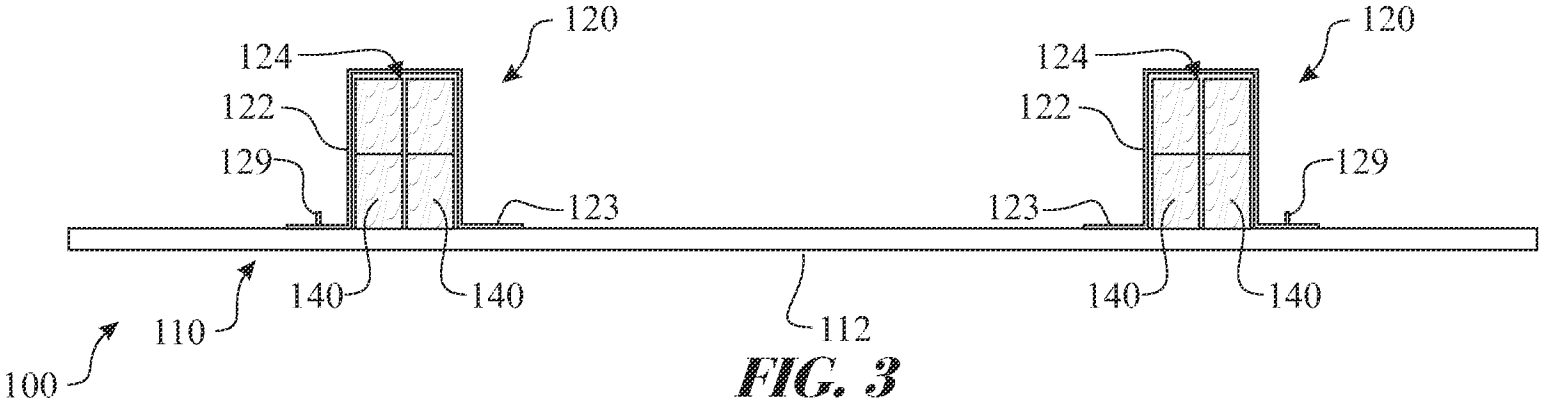
FIG. 3 presents a side elevation view of the display table and shipping platform apparatus of FIG. 1, shown in a shipping configuration.
Figure 4:
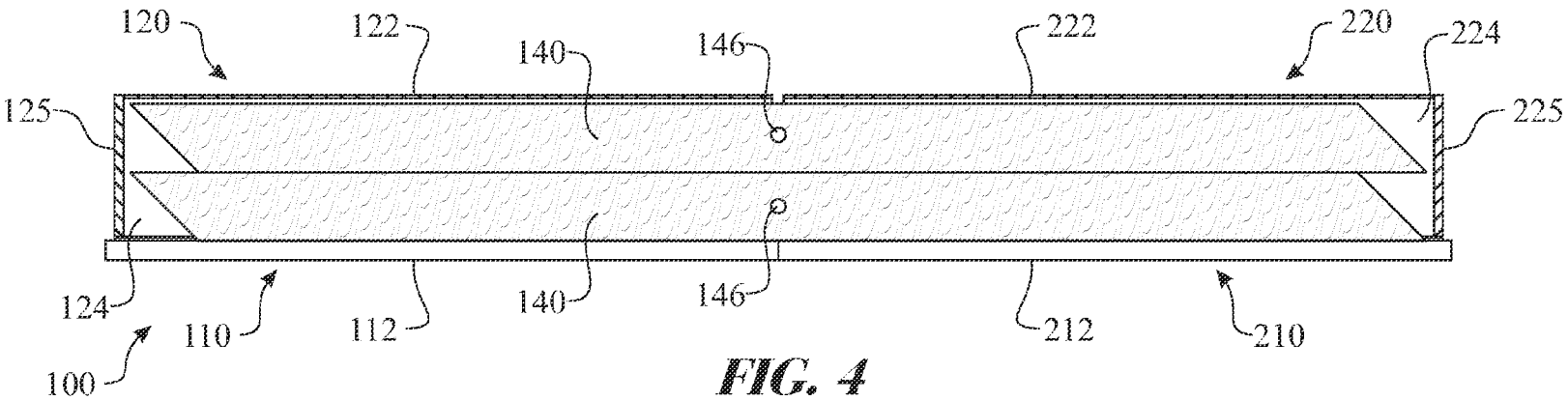
FIG. 4 presents a sectioned end elevation of the display table and shipping platform apparatus taken along section 4-4 of FIG. 2.
Figure 5:
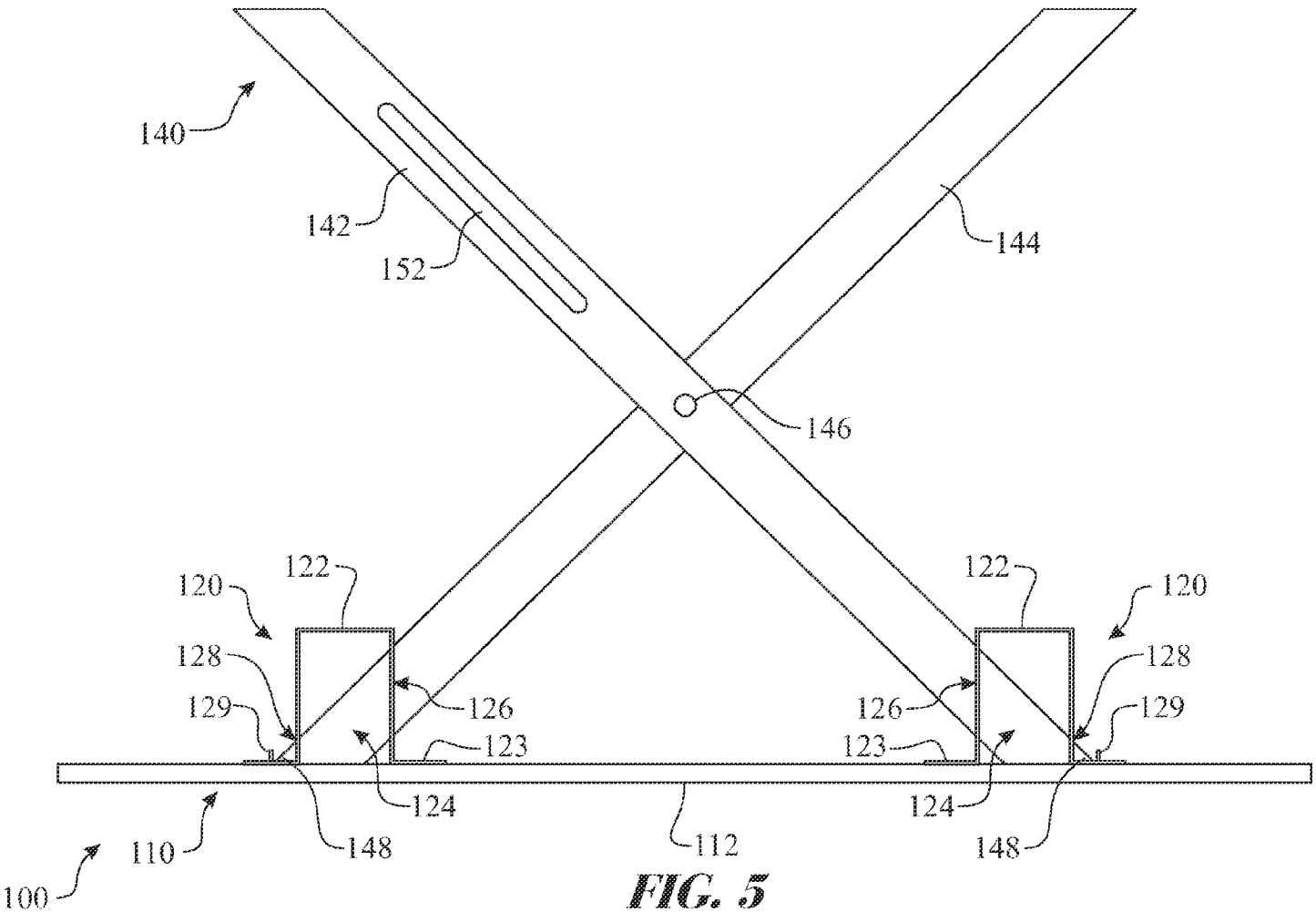
FIG. 5 presents a side elevation view of the display table and shipping platform apparatus of FIG. 1, shown in a display table configuration.

The bracket assembly 120 is fabricated having a leg receiving frame member 122 forming a leg storage channel 124. The leg storage channel 124 is preferably of a shape and size to receive a pair of leg subassemblies 140 as illustrated in FIGS. 3 and 4. The preferred shape of the leg receiving frame member 122 comprises a box section having a pair of bracket mounting flanges 123 extending outward from a mounting edge of the box section. The bracket mounting flange 123 is utilized for attaching the bracket assembly 120 to the platform assembly 110. The bracket assembly 120 is attached to the platform assembly 110 via any form of mechanical fastener, including screws, bolts, adhesive, and the like. A pair of interior leg receiving aperture 126 and exterior leg receiving aperture 128 are formed through the sidewalls of the leg receiving frame member 122 for receiving the leg subassembly 140. Details of the apertures 126, 128 and assembly will be described at a later point in the disclosure. A leg storage end cap 125 can be provided at one end of the bracket assembly 120. The leg storage end cap 125 ensures the leg subassemblies 140 remains within the leg storage channel 124 of the bracket assembly 120. The leg storage end cap 125 can be solid, partially covering the open end of the leg storage channel 124, affixed, removable, and the like.

The leg subassemblies 140 are fabricated having a first leg 142, and a second leg 144 being pivotally assembled via a leg attachment pivot member 146. The ends of the legs are preferably shaped having the shoulder end 148 cut at an angle for insertion into the leg receiving apertures 126, 128. A foot end can be shaped in any desirable shape for adequately supporting the display table and shipping platform apparatus 100 when in a table configuration.

A platform handle 114 can be provided through the platform 112 offering the user a location from gripping the platform 112, securing strapping, and the like. It is understood that any handle design can be integrated with the platform assembly.

A pair of pinned attachment interfaces 132 secures the first platform assembly 110 to the second platform assembly 210. The second platform assembly 210 is assembled comprising the same components of the first platform assembly 110. Like features of second platform assembly 210 and first platform assembly 110 are numbered the same except preceded by the numeral '2'. The first platform assembly 110 and second platform assembly 210 are mating components, wherein each being preferably the same shape, size, and configuration. The platform assemblies 110, 210 are designed positioning each bracket assembly 120 equidistant from, and parallel to, a centerline extending perpendicularly from a center point of a mating (longer) edge of the platform 112. This configuration allows the user to position the mating edge 116 of the first platform assembly 110 butting against a mating edge 216 of the second platform assembly 210. The first platform bracket assembly 120 aligns with the second platform bracket assembly 220 forming a single storage channel for the leg subassemblies 140 as best illustrated in FIG. 4. Besides storage, the leg subassemblies 140 create a beam, providing structural support to the display table and shipping platform apparatus 100.

In the preferred embodiment, the platform 112 is fabricated of wood, such as ¾" or 1" plywood. The edges would be finished to remove sharp edges, minimize splintering, and avoid any injury to others. Features such as the platform handle 114 and platform-to-platform attachment interface 130 can be machined into the platform 112 via any machining process. The platform 112 can alternately be fabricated of a moldable material such as recycled plastics via a molding process. Features such as the platform handle 114 and platform-to-platform attachment interface 130 would be formed therein during the molding process. The bracket assembly 120 is preferably fabricated of a single formed metal sheet. The apertures 126, 128 would be stamped through the material prior to shaping. Alternately, the material can be extruded and subsequently machined. The leg storage end cap 125 can be formed from the single metal sheet and secured into positioned via a welding process, a mechanical fastener, and the like. Alternately, the leg storage end cap 125 can be removably attached to the leg receiving frame member 122 via any reasonable mechanical interface. The leg subassemblies 140 are fabricated having a pair of wooden legs 142, 144 being pivotally assembled via a pivot fastener 146. The pivot fastener 146 can be fabricated of metal, plastic, wood, and the like. The bracket assemblies 120 are assembled to the underside of the platform 112 via a series of mechanical fasteners, such as wood screws, bolts, adhesive, and the like.

Figure 6:
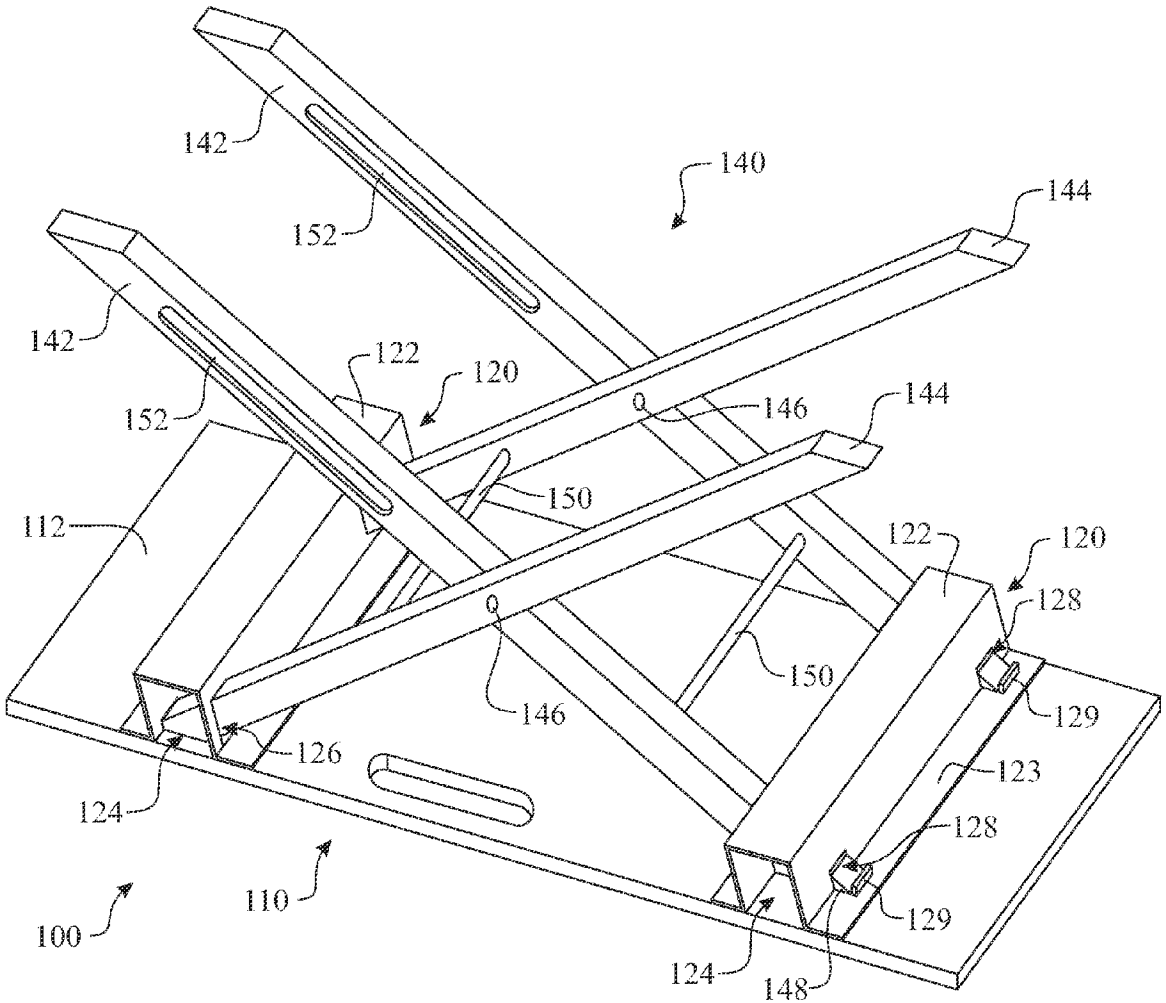
FIG. 6 presents an isometric underside view of the display table and shipping platform apparatus of FIG. 1, shown in a display table configuration.
Figure 7:
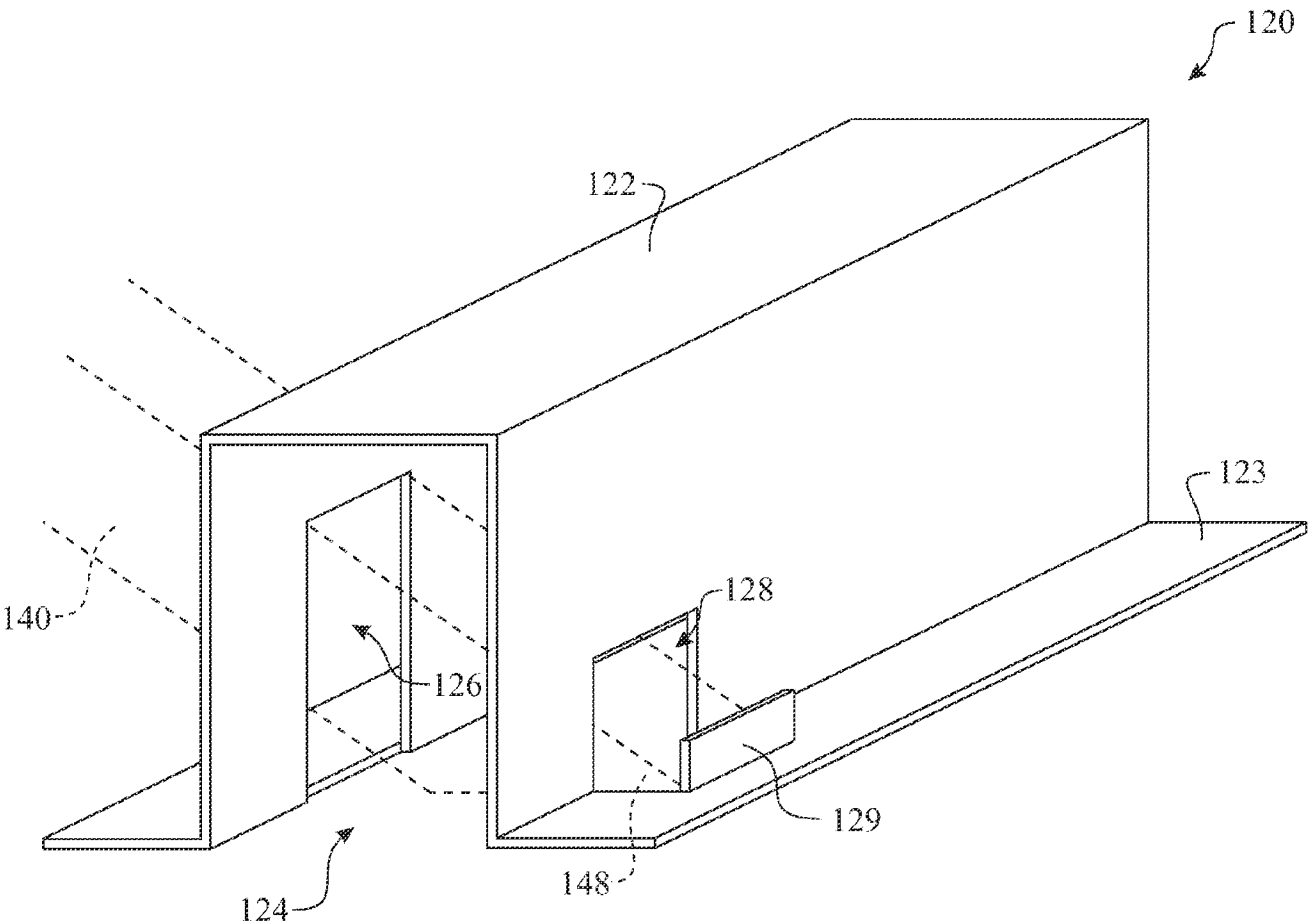
FIG. 7 presents an isometric view detailing a leg to platform attachment interface.
Figure 8:
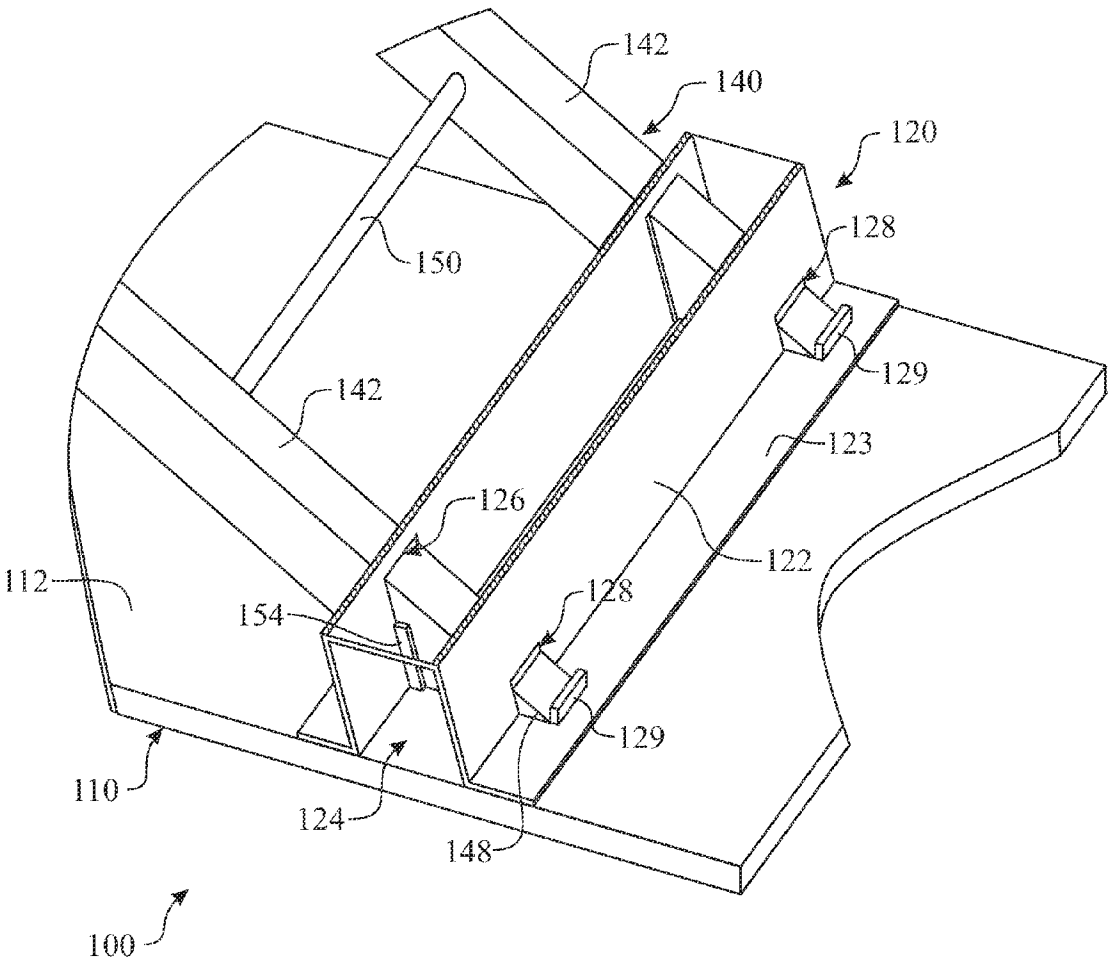
FIG. 8 presents an isometric view detailing a leg to platform attachment interface, further illustrating a leg locking tab.
Figure 9:
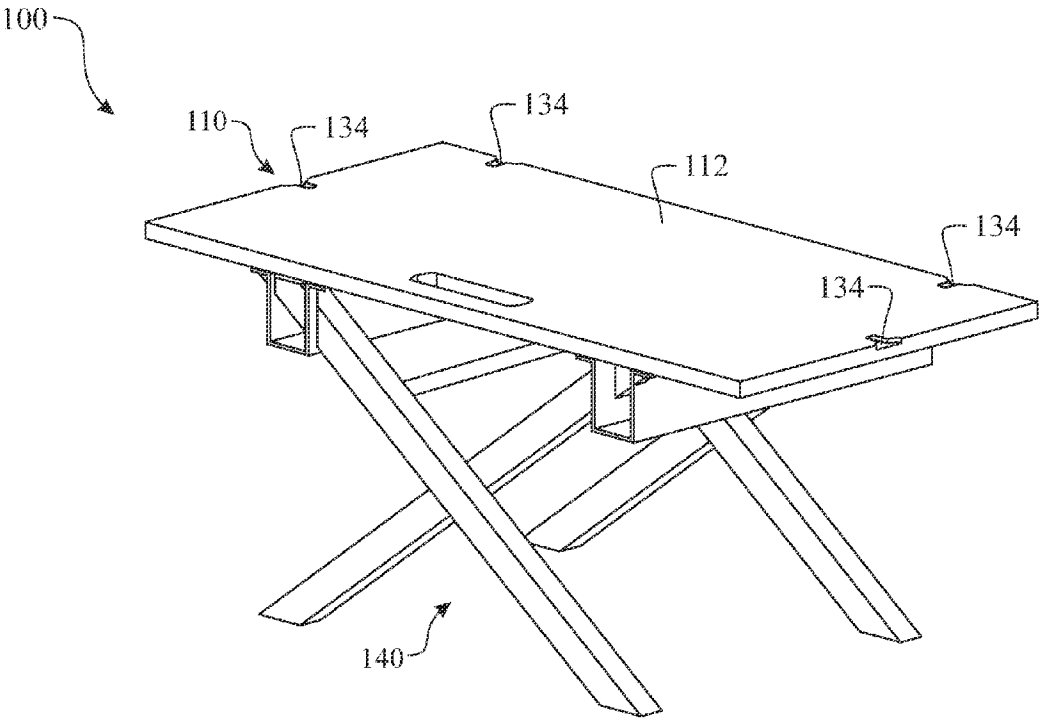
FIG. 9 presents an isometric topside view of the display table and shipping platform apparatus of FIG. 1, shown in a display table configuration.

The exemplary display table and shipping platform apparatus 100 is illustrated in a table or display configuration as presented in FIGS. 5 through 9. A worker disengages the platform-to-platform attachment interface 130 allowing the platform assembly 110 to separate from the platform assembly 210. The separation provides access to the leg subassemblies 140 stored within the leg storage channels 124, 224. The worker removes the leg subassemblies 140 from the leg storage channels 124, 224. The worker removes the wobble braces 150 from the wobble brace storage slots 152, setting them temporarily aside. The first leg 142 and second leg 144 are then pivoted into an "X" shape. Each shoulder 148 is inserted a respective set of leg receiving apertures 126, 128, as detailed in FIG. 7. The shoulder 148 is positioned abutting a leg stop tab 129. The shoulder 148 can also be wedged into the exterior leg receiving aperture 128, providing a frictional interface between the surface of the shoulder 148 contacting the underside of the platform 112 and the opposite edge of the exterior leg receiving aperture 128. A leg locking tab 154 can optionally be attached to at least one leg 142, 144 proximate the respective shoulder 148. The thickness of the combined leg 142, 144 and leg locking tab 154 equals a width of the interior leg receiving aperture 126, allowing for the worker to slip the leg locking tab 154 through the interior leg receiving aperture 126. The wobble brace 150 is then installed spanning between the respective pair of legs 142, 144 as best illustrated in FIG. 6. The desired wobble brace 150 are fabricated from dowels. Each wobble brace 150 is inserted into a pair of holes drilled into the legs 142, 144. A tapered lead-in may be formed about one of the pair of holes to aid in the insertion of the wobble brace 150. The wobble brace 150 separates the legs 142, 144. The wobble brace 150 also engages the leg locking tab 154 against an interior surface of the leg receiving frame member 122, locking the shoulder 148 in position. The worker then inverts the table version of the display table and shipping platform apparatus 100, as illustrated in FIG. 9. It is understood that a slot or notch may be provided in each leg 142, 144 as an alternate to the leg locking tab 154.

The "X" configuration of the leg subassemblies 140 provides an additional benefit. As weight is added to the table, the legs are rotated outward. The rotation increases the wedge of the shoulder 148 into the exterior leg receiving aperture 128, strengthening the interface.

Figure 10:
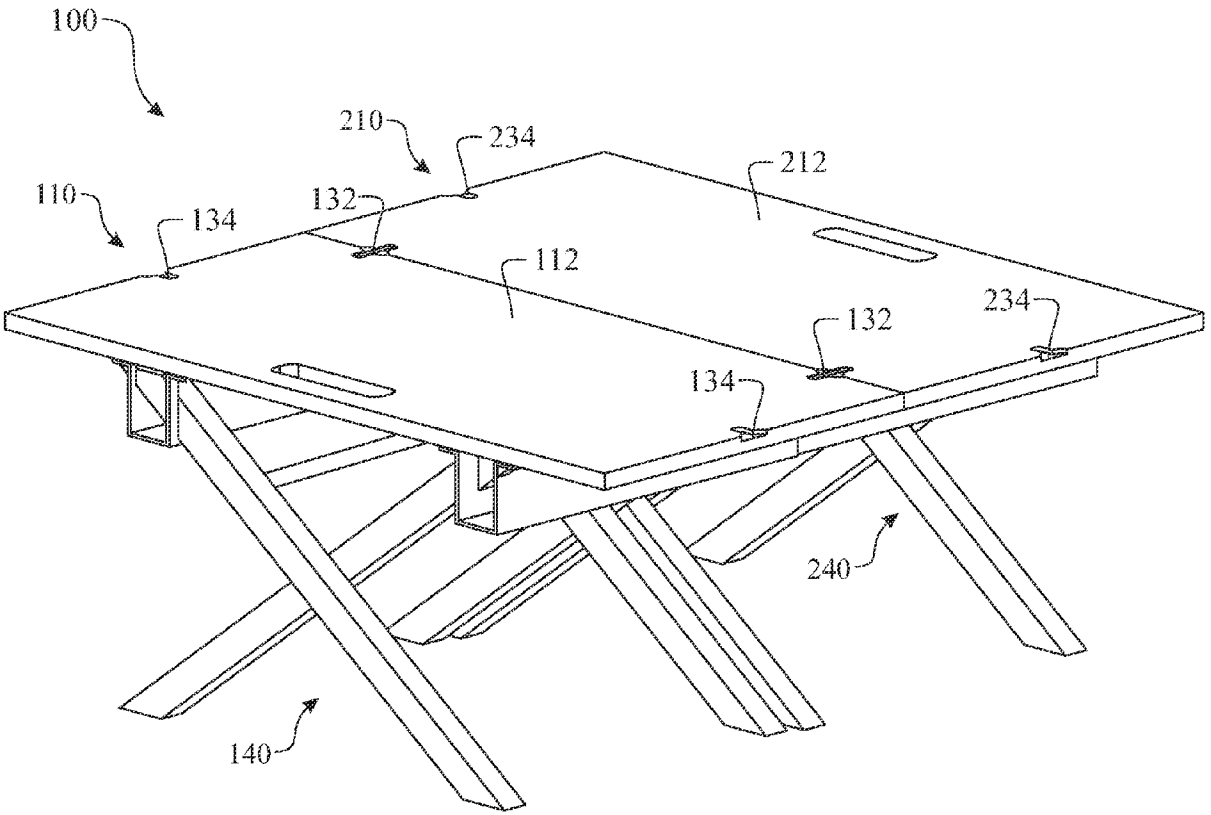
FIG. 10 presents an isometric view of a pair of tables assembled together mating the longer edges of the platforms to extend the depth of the display surface.
Figure 11:
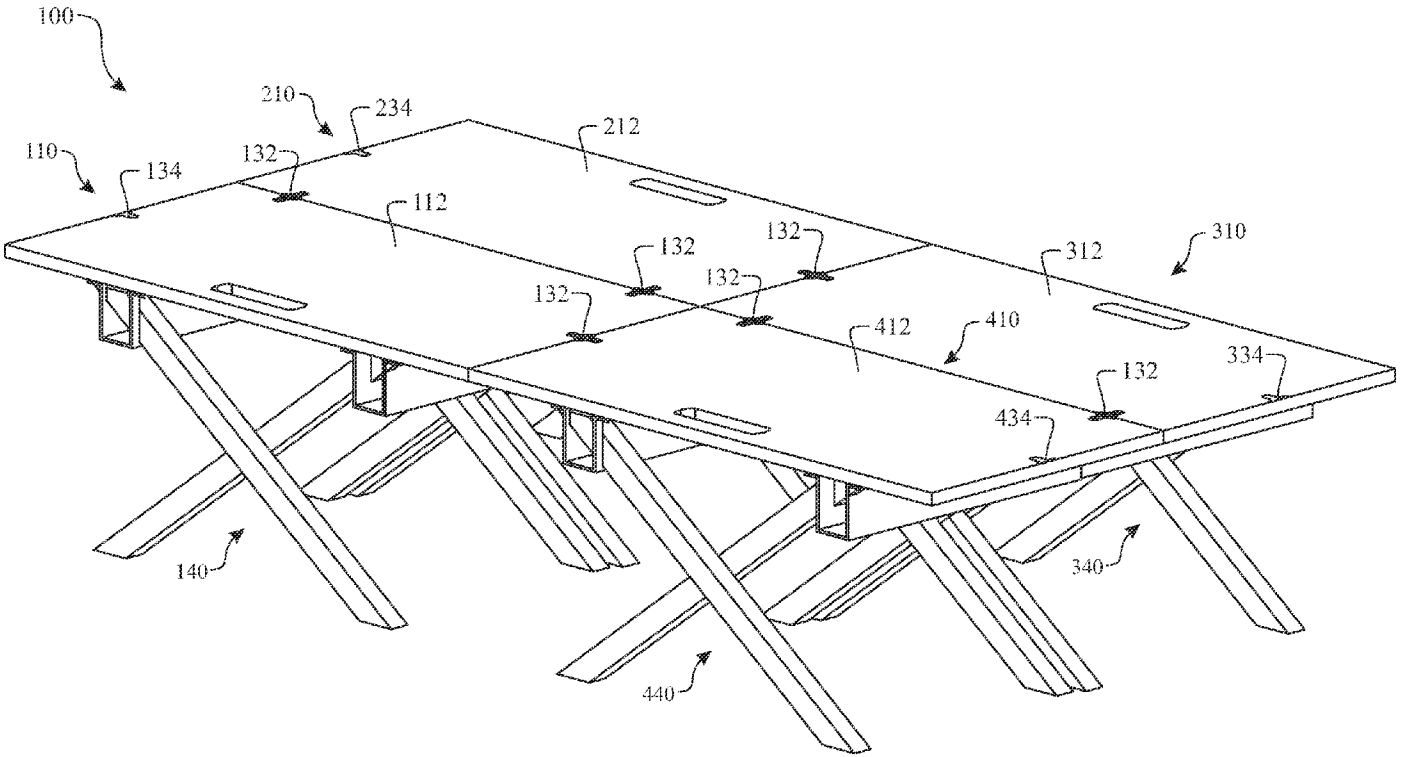
FIG. 11 presents an isometric view of a plurality of tables assembled together mating the longer edges of the platforms to extend the depth of the display surface and mating the shorter edges of the platforms to extend the length of the display surface.
Figure 13:
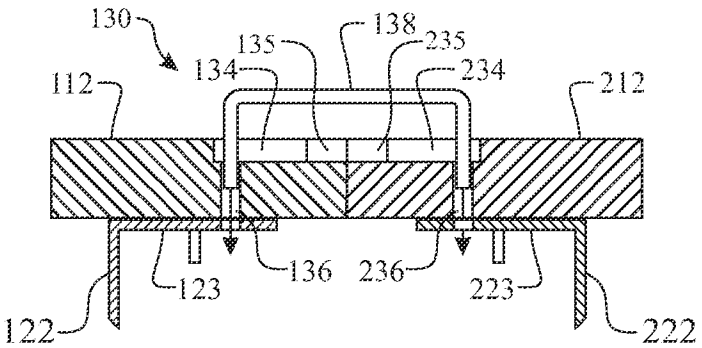
FIG. 13 presents sectioned end elevation of the exemplary platform-to-platform attachment interface taken along section 13-13 of FIG. 12.
Figure 12:
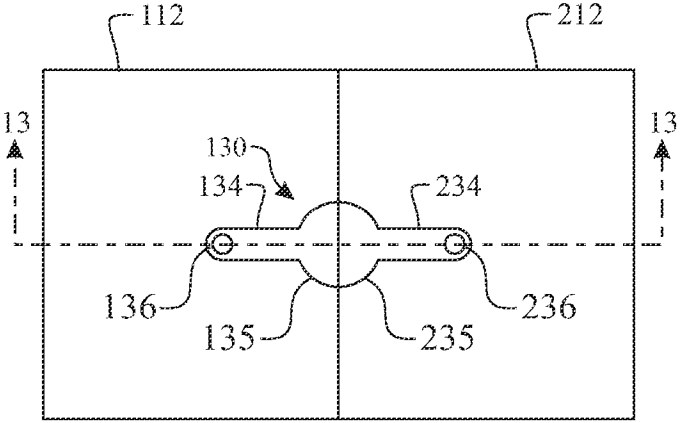
FIG. 12 presents a planar top view of an exemplary platform-to-platform attachment interface.

To enlarge the display surface, the worker can attached a plurality of tables 100 together, as demonstrated in the exemplary illustrations shown in FIGS. 10 through 13. The series of platform assemblies 110, 210, 310, 410 are the same assemblies, being numbered accordingly for clarity in defining the assembly process. The third platform assembly 310 is assembled comprising the same components of the other platform assemblies 110, 210. Like features of third platform assembly 310 and other platform assemblies 110, 210 are numbered the same except preceded by the numeral '3'. The fourth platform assembly 410 is assembled comprising the same components of the other platform assemblies 110, 210, 310. Like features of fourth platform assembly 410 and platform assemblies 110, 210, 310 are numbered the same except preceded by the numeral '4'. The depth of the display table can be increased by joining the first platform assembly 110 with the second platform assembly 210 along the longer edge via a series of pinned attachment interfaces 132 as illustrated in FIG. 10. The length of the table can be increased by joining the first platform assembly 110 with the fourth platform assembly 410 (similarly joining a second platform assembly 210 with a third platform assembly 310) along the shorter edge via a series of pinned attachment interfaces 132 as understood from the illustration of FIG. 11. The exemplary configuration allows the worker to create a wider and longer table by joining a plurality of tables 110, 210, 310, 410 together as illustrated in FIG. 11.

The exemplary joining method utilizes a first attachment interface recession half 134 mated with a second attachment interface recession half 234. A first pin aperture 136 is disposed through the platform 112, and preferably aligned and continuing through an outer bracket mounting flange 123. Similarly a second pin aperture 236 is disposed through the platform 212, and preferably aligned and continuing through an outer bracket mounting flange 223. A securing pin 138 is formed in a square "U" shape with each end being inserted through each pin aperture 136, 236, forming the pinned attachment interface 132, securing the platform 112 with the platform 212. A finger clearance is formed by each of the first removal finger clearance half 135 and second removal finger clearance half 235, giving the worker the ability to access, grip, and remove the securing pin 138 from the pinned attachment interface 132.

Figure 14:
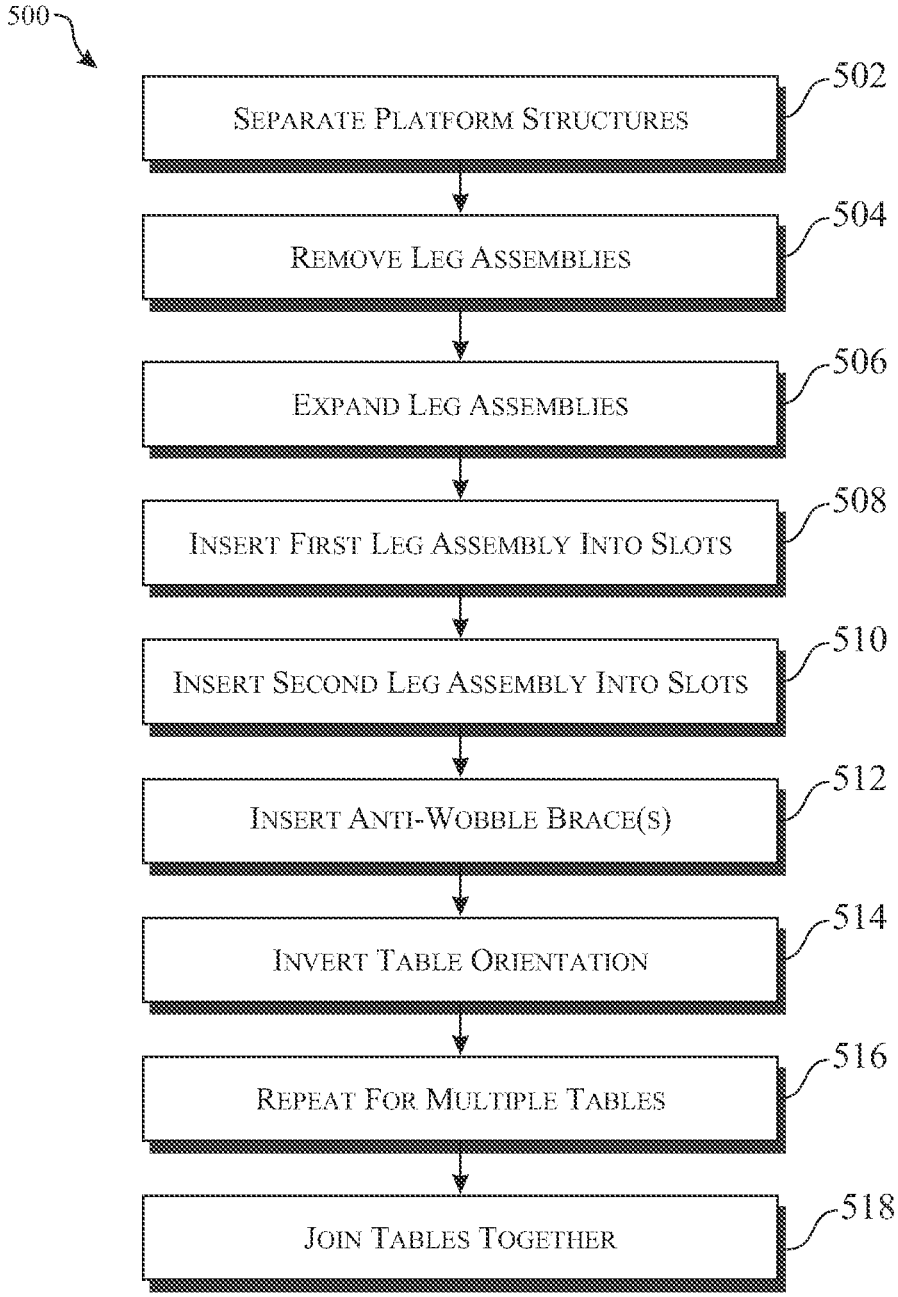
FIG. 14 presents a flow diagram detailing a platform to table conversion process.

A table conversion flow diagram 500 is illustrated in FIG. 14. A worker initiates the process by separating 502 the two platform assemblies 112, 212. The leg subassemblies 140 are removed from the leg storage channel 124 in accordance with a leg removal step 504. The first leg 142 and second leg 144 are pivoted into an "X" configuration via a leg expansion step 506. The shoulder 148 is inserted into the leg receiving apertures 126, 128 of the bracket assembly 120 following a first leg subassembly insertion step 508. The leg insertion step is repeated 510, assembly a second leg subassembly to the platform assembly 110. A wobble brace 150 is assembled between the pair of legs as directed in an anti-wobble brace insertion step 512. The worker checks to ensure the leg subassembly 140 are properly secured to the platform assembly 110, and upon verification, the assembly is inverted 514 into a table configuration. The process is repeated 516, assembling additional table assemblies. The plurality of table assemblies are joined 518 as desired to increase the width, the length, or both.

One of the benefits of the display table and shipping platform apparatus 100 is that the apparatus 100 resolves the issue for storing and retrieving the shipping materials. The display table and shipping platform apparatus 100 remains at the display without taking up valuable space. It is common to have union personnel aiding marking people at expositions. This practice limits the accessibility to stored materials during and after the exposition to only a select few individuals. Due to the limited number of people allowed to access and retrieve the stored materials, the time required to retrieve the materials is significantly higher. The shipping display table assembly 100 easily converts between a shipping configuration and a display configuration without any tooling.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A display table and shipping platform apparatus comprising:

a first platform assembly;

a second platform assembly;

each platform assembly comprising a platform and a pair of leg receiving frame members disposed upon an underside of each platform, said pair of leg receiving frame members being parallel and symmetrically arranged to the underside of each platform;

at least two leg subassemblies, each leg subassembly comprising a pair of legs being pivotally attached proximate a central portion of said legs; and each leg receiving frame member comprises a pair of leg receiving apertures for receiving a shoulder of each leg when assembled into a display configuration, wherein each leg receiving frame member is formed for receiving and storing said leg subassemblies therein when assembled into a shipping configuration.

2. A display table and shipping platform apparatus as recited in claim 1, said platform assembly further comprising:

each leg receiving aperture is provided comprising an interior leg receiving aperture provided through an central vertical wall portion of said leg receiving frame member and an exterior leg receiving aperture provided through an outer vertical wall portion of said leg receiving frame member.

3. A display table and shipping platform apparatus as recited in claim 2, said platform assembly further comprising:

wherein a height of said interior leg receiving aperture is larger than a height of said exterior leg aperture.

4. A display table and shipping platform apparatus as recited in claim 3, said platform further comprising:

a leg stop tab extending outward from said underside of said platform and located outward from each said exterior leg aperture, wherein said leg stop tab is provided to limit an insertion of said shoulder of said respective leg.

5. A display table and shipping platform apparatus as recited in claim 1, said platform further comprising:

a first attachment interface provided in said first platform;

a second attachment interface provided in said second platform;

wherein said first attachment interface and said second attachment interface are located along mating edges of each respective platform and in registration with each other; and an attachment mechanism which detachably secures said first attachment interface and said second attachment interface.

6. A display table and shipping platform apparatus as recited in claim 5, wherein said attachment mechanism is a securing pin having a "U" shape and each end is inserted through a pin aperture included in each attachment interface, respectively.

7. A display table and shipping platform apparatus as recited in claim 1, said platform further comprising:

a platform handle provided through at least one of said first platform and said second platform.

8. A display table and shipping platform apparatus as recited in claim 1, said leg subassemblies further comprising:

a wobble brace being removably assembled to and spanning between a pair of adjacent legs when assembled into a display configuration.

9. A display table and shipping platform apparatus as recited in claim 8, said leg subassemblies further comprising:

at least one wobble brace storage slot included within at least one said leg, wherein said wobble brace storage slot is sized to receive and store said wobble brace when assembled into a shipping configuration.

10. A display table and shipping platform apparatus comprising:

a platform assembly;

said platform assembly comprising a platform and a pair of leg receiving frame members disposed upon an underside of the platform, said pair of leg receiving frame members being parallel and symmetrically arranged to the underside of said platform;

a pair of leg subassemblies, each leg subassembly comprising a pair of legs being pivotally attached proximate a central portion of said legs; and each leg receiving frame member comprises a pair of leg receiving apertures for receiving a shoulder of each leg when assembled into a display configuration, wherein each leg receiving frame member is formed for receiving and storing said leg subassemblies therein when assembled into a shipping configuration.

11. A display table and shipping platform apparatus as recited in claim 10, said platform assembly further comprising:

each leg receiving aperture is provided comprising an interior leg receiving aperture provided through an central vertical wall portion of said leg receiving frame member and an exterior leg receiving aperture provided through an outer vertical wall portion of said leg receiving frame member.

12. A display table and shipping platform apparatus as recited in claim 11, said platform assembly further comprising:

wherein a height of said interior leg receiving aperture is larger than a height of said exterior leg aperture.

13. A display table and shipping platform apparatus as recited in claim 12, said platform further comprising:

a leg stop tab extending outward from said underside of said platform and located outward from each said exterior leg aperture, wherein said leg stop tab is provided to limit an insertion of said shoulder of said respective leg.

14. A display table and shipping platform apparatus as recited in claim 10, said platform further comprising:

an attachment interface provided in said platform for attachment of a pair of adjacently positioned platforms, said attachment interface being located along a mating edge of said platform; and an attachment mechanism which detachably secures said attachment interface with an attachment interface of said adjacently positioned platform.

15. A display table and shipping platform apparatus as recited in claim 14, wherein said attachment mechanism is a securing pin having a "U" shape and each end is inserted through a pin aperture included in each attachment interface, respectively.

16. A display table and shipping platform apparatus as recited in claim 10, said platform further comprising:

a platform handle provided through said platform.

17. A display table and shipping platform apparatus as recited in claim 10, said leg subassemblies further comprising:

a wobble brace being removably assembled to and spanning between a pair of adjacent legs when assembled into a display configuration.

18. A display table and shipping platform apparatus as recited in claim 17, said leg subassemblies further comprising:

at least one wobble brace storage slot included within at least one said leg, wherein said wobble brace storage slot is sized to receive and store said wobble brace when assembled into a shipping configuration.

* * * * *